US008246031B2

(12) United States Patent
Ramseier

(10) Patent No.: US 8,246,031 B2
(45) Date of Patent: Aug. 21, 2012

(54) GATHERING AND STITCHING MACHINE

(75) Inventor: Marcel Ramseier, Wetzikon (CH)

(73) Assignee: Ferag AG, Hinwill (CH)

( * ) Notice: Subject to any disclaimer, the term of this patent is extended or adjusted under 35 U.S.C. 154(b) by 0 days.

(21) Appl. No.: 13/032,144

(22) Filed: Feb. 22, 2011

(65) Prior Publication Data

US 2011/0198796 A1 Aug. 18, 2011

Related U.S. Application Data

(62) Division of application No. 12/084,871, filed on May 12, 2008, now Pat. No. 7,900,902.

(30) Foreign Application Priority Data

Nov. 11, 2005 (CH) ..... 1808/05

(51) Int. Cl.
*B65H 39/00* (2006.01)
*B65H 37/04* (2006.01)

(52) U.S. Cl. ..... 270/52.18; 270/52.14; 270/52.16; 270/52.26; 270/52.29; 270/52.3

(58) Field of Classification Search ..... 270/52.14, 270/52.16, 52.18, 52.26, 52.29, 52.3
See application file for complete search history.

(56) References Cited

U.S. PATENT DOCUMENTS

| | | | | |
|---|---|---|---|---|
| 4,489,930 | A | 12/1984 | Meier | |
| 5,098,002 | A | 3/1992 | Hansch et al. | |
| 5,342,032 | A | 8/1994 | Meier | |
| 5,417,410 | A | 5/1995 | Meier | |
| 5,464,199 | A | 11/1995 | Stauber | |
| 5,590,828 | A | 1/1997 | Stauber | |
| 5,810,345 | A | 9/1998 | Lehmann et al. | |
| 2002/0140154 | A1 * | 10/2002 | Trovinger | 270/58.08 |
| 2002/0140155 | A1 | 10/2002 | Muller | |

FOREIGN PATENT DOCUMENTS

| | | | |
|---|---|---|---|
| DE | 196 38 448 | A1 | 5/1997 |
| EP | 0 095 603 | A1 | 12/1983 |
| EP | 0 202 507 | A2 | 11/1986 |
| EP | 0 399 322 | A2 | 11/1990 |
| EP | 0 566 531 | A1 | 10/1993 |
| EP | 0 546 326 | B1 | 9/1995 |
| EP | 0 691 215 | A1 | 1/1996 |

* cited by examiner

*Primary Examiner* — Leslie A Nicholson, III
(74) *Attorney, Agent, or Firm* — Pauley Petersen & Erickson

(57) ABSTRACT

A new gathering and stitching machine (10) and a new method for operating a gathering and stitching machine (1) are proposed, which make it possible to drive in the staples (K) in a positionally correct manner and to close them satisfactorily even in the case of relatively short staple setting times. This is achieved by the novel control of the position of the staple heads (20) and the saddle-shaped supports (2, 30, 40, 50) in the region of the interaction during stapling. It is an essential feature of the present invention that the staple head (20) and the support (2, 30, 40, 50) are pivoted towards one another in such a way that they come to lie within a common stapling plane (H). This means that the saddle plane which is defined by the pivoting axis (S) of the saddle-shaped support (2, 30, 40, 50) and the support edge (13) and the staple-head plane which is defined by the pivoting axis of the staple head (20) and the ram tip are superimposed on one another in the region of the interaction and for the duration of the interaction and define what is known as the stapling plane (H). Here, the stapling plane (H) is pivoted continuously, with the result that it stands orthogonally on the main conveying plane (X) only in a central position.

13 Claims, 5 Drawing Sheets

B
20
22
21
K
11
13/S
P''
W
P
P'
2''
2'
23
U/H
N
H/V
H/O
H/N
14
H/Q
13/17
W
H/R
F/x
H/U
17'
13'
W'
30''
30
30'
S'
P'''
P''

GATHERING AND STITCHING MACHINE

CROSS REFERENCE TO RELATED APPLICATION

This application is a divisional of application Ser. No. 12/084,871, filed on 12 May 2008 now U.S. Pat. No. 7,900,902. The co-pending parent application is hereby incorporated by reference herein and is made a part hereof, including but not limited to those portions which specifically appear hereinafter.

BACKGROUND OF THE INVENTION

1. Field of the Invention

The invention lies in the field of collecting and processing multi-part folded printed products and relates to a device and a method for the collection, transport, possible processing and the stitching of printed products.

2. Discussion of Related Art

Collecting and stitching devices with endlessly revolving conveyor members, which comprise a plurality of rests, are known from the state of the art. Basically, collecting and stitching devices serve for the manufacture of magazines, newspapers, brochures etc., from finished printed and folded sheets. For this, the printed sheets and the cover are applied over one another, aligned and stitched, in the desired sequence.

A device for processing folded printed sheets is known from EP0202507, with which a plurality of saddle-like rests are provided for the straddled receipt of the printed sheets along a conveyor path, with a rest edge aligned transversely to the conveyor path. The endlessly revolving conveyor member transports the saddle-like rests past a plurality of working stations, wherein at least one working station is a stitching station with revolving stitching heads. A product to be stitched is lifted from the saddle from below, in each case by a separately driven anvil and is stitched from above by way of a stitching head which synchronously runs with it. The anvil and stitching head, when stitching, are in each case located in a perpendicular position in relation to the plane, through which the rest edges run along the conveyor path. The anvil is mounted in a vertically upwardly movable manner on its conveyor belt, in the region of the cooperation, whilst the stitching head is arranged in a fixed position in this spatial direction. With this orthogonal guidance of the stitching head and saddle, the time which is available for stitching is set in a fixed manner on account of the length of the region of cooperation and the speed of the conveyor means. If the conveyor speed is to be increased, then the time which is available for stitching necessarily, is compellingly shortened. Moreover, the lifting of the printed sheets from the saddle, which is envisaged there, is laborious and is disadvantageous with regard to the precision on the stitching.

A further gathering and stitching device is described in DE19638448, with which again saddle-like rests are transported along a conveyor path with rest edges directed transversely to the conveyor path, past at least one working station. The saddle-like rests are movably mounted on their pull member, so that their rest edges may run through a movement path which is in opposite directions to the transport movement, with the passage through the region of the cooperation with the stationary working station, so that approximately a temporary standstill of the rest edges relative to the fixedly arranged working station, in particular a product feed station, is achieved. Again for stitching, it is suggested to reduce the relative speed of the saddle-like rests in relation to the stationary stitching apparatus. This is effected by way of two crank drives which are arranged in a manner which is fixed with regard to movement, are driven equal in phase and which slow down the components of the speed of the rests, which are directed parallel to the conveyor path, on transport past the stationary stitching apparatus in a first phase, then briefly keep them close to the value zero and subsequently accelerate them back to the speed of the pull member. The saddle-like rests thereby always remain aligned orthogonally to the conveyor path. With the conveyor speeds which are common today in the medium performance or high performance field, such a speed reduction and subsequent acceleration entails enormous loading of the participating components. The time of cooperation of the stitching head and the saddle-like rest is again compellingly set by the speed of the conveyor means. Moreover, the change of the relative speed of the rest to the working station may be influenced purely by the control of the rest.

A collecting and stitching device is known form EP566531, with which the rests after the end of the feed, are led to a deflection wheel comprising a bending device. It is described that the rests in the deflection wheel come to lie on bending devices aligned in the stitching movement direction. The bending devices and rests must be guide over one another in a precise manner, in order to ensure a stable stitching position. Particularly high demands are made with regard to the meshing of the rests into the stitching drum. Since the feed of the printed products to the deflection wheel takes up much space, it is suggested to design the rests in a pivotable manner about an axis between the conveyor chains of the pull means, said axis running transversely to the conveyor direction, so that they may be rotated in the run-in section. A control cam is provided for this, by way of which the rests may be pivoted in a positive manner. After meshing into the deflection wheel, the rests are held in their defined radial position and rotate about the axis of the deflection wheel. It is disclosed that the stitching device comprises several rotation stitching heads which are driven synchronously with the deflection wheel on a parallel circular arc with the stitching procedure. A pivoting of the rests between the conveyor chains of the pull means in the stitching region is no longer possible.

A device for wire stitching multi-part printed products on a collection drum by way of a rotating stitching unit with a plurality of circularly revolving stitching heads is known from EP546326. The likewise circularly revolving rests of the collection drum, in a region of the cooperation, force the stitching heads against the inside of their circular revolving path, so that a flattening of this circular path is effected in the stitching region. The result of this is that the stitching heads may accompany the rests for a certain while. An extension of the stitching region is achieved by way of this. This contributes to the staples being driven into the printed products in a perfect manner at the correct location and in the correct position and being able to be well bent. Preferably, the stitching heads during the stitching procedure are held in an exactly aligned or approximately aligned position with an associated rest, by which means the conditions under which the staples are inserted, are once again improved. The maintenance of the aligned position must be accomplished solely by the pivot movement of the stitching heads, since the rests in the drum are not pivotably movable.

It is then the object of the present invention to provide a device and a method of the initially cited type, with which the disadvantages cited above are largely overcome, and with which the time which is available for an optimal stitching result, is no longer compellingly dependent on the conveyor speed of the conveyor member. This is to be rendered possible without having to compromise with regard to the quality of the stitching result. A perfect and positionally correct stitching of printed products is to be made simple, even at greater working speeds.

A further object of the invention lies in permitting a change in the course of the processing with relatively little effort.

According to the invention, this object is achieved by a device with the features of the characterizing part of claim 1 and by a method with the features of patent claim 13.

SUMMARY OF THE INVENTION

An essential feature of the invention lies in the stitching head and the saddle-like rest running through a coordinated pivot movement about a common pivot axis in the region of the cooperation, when stitching, wherein the pivoting of the stitching head and the rest does not necessarily have to be effected about a common physical pivot axis, but may also be effected by way of suitable movement controls, which cause the desired pivoting about the pivot axis according to the invention. In order to be able to drive in the staples in a positionally correct manner and to close them in a perfect manner, even with short or very short staple-stitching times, it has been found to be advantageous to arrange the stitching heads and the saddle-like rests in a common plane during the procedure of applying the staples, so that the ram of the stitching head may drive in the staples essentially exactly linearly onto the assigned rest and their bending devices with bunched stitching. The angular position of the ram with respect to the staple bending device is therefore basically not changed during the cooperation. With the known devices described above, this is achieved or attempted by way of aligning the parts of the device, which cooperate on stitching, to one another in a plane arranged transversely to the conveyor direction. With the devices and methods according to the present invention, although the stitching head and saddle-like rest continue to be held in the advantageous 180° angular position, in the so-called stitching plane, both however are pivoted with respect to the conveyor plane whilst maintaining this angular position to one another. In the region of the cooperation, the two pivot movements in equal directions are matched to one another such that they coincide in a plane and are effected about a single common (theoretical) pivot axis.

With the invention, thus one not only does away with the rigid fastening of the saddle-like rest on the conveyor member, as is usual with known stitching apparatus, but it is supplemented in a synergistic manner by the pivotably movable mounting of the stitching heads along a circular revolving path. Since the stitching heads as well as the saddle-like rests playa part in the pivoting movement, the load distribution on the components to be moved is significantly more favorable, since the pivot movement is distributed onto both device parts. Moreover, a larger degree of freedom for the design of the device and a mutual matching of the stitching head and rests results, so that the quality of the stitching may also be improved.

This movable mounting is designed in a manner such that the rest edges of the saddle-like rest and the fronts of the stitching head ("stitching head tips") may be led at a lower, greater or equal speed in comparison to the conveyor member speed, in the whole stitching region, wherein the optimal alignment of the stitching heads and the rests in the stitching plane is always ensured. Solutions with which the speed of the rests in the stitching region is the same or larger than the conveyor member speed are particularly advantageous for a high quality stitching in cooperation with rotation stitching apparatus.

The advantages of the long time which is available for stitching in the optimal position, as are known from EP546326 for stitching drums or collecting drums in combination with stitching heads which are moved along a circular revolving path, by way of the present invention, may be conveyed upon to installations with a more flexible or more economical ladder circulation conveyor (Leiterumlauf) whilst making do without the stitching drums with their large space requirement and investment requirement. A ladder circulation conveyor (Leiterumlauf) of a device according to one embodiment of the present invention comprises a multitude of saddle-like rests which are led past different processing stations by a conveyor member along a main conveyor direction in an upper section the revolving path.

BRIEF DESCRIPTION OF THE DRAWINGS

Embodiment examples of the subject matters of the invention are hereinafter described in more detail by way of the figures. There are shown in.

DESCRIPTION OF PREFERRED EMBODIMENTS

Figure 1:
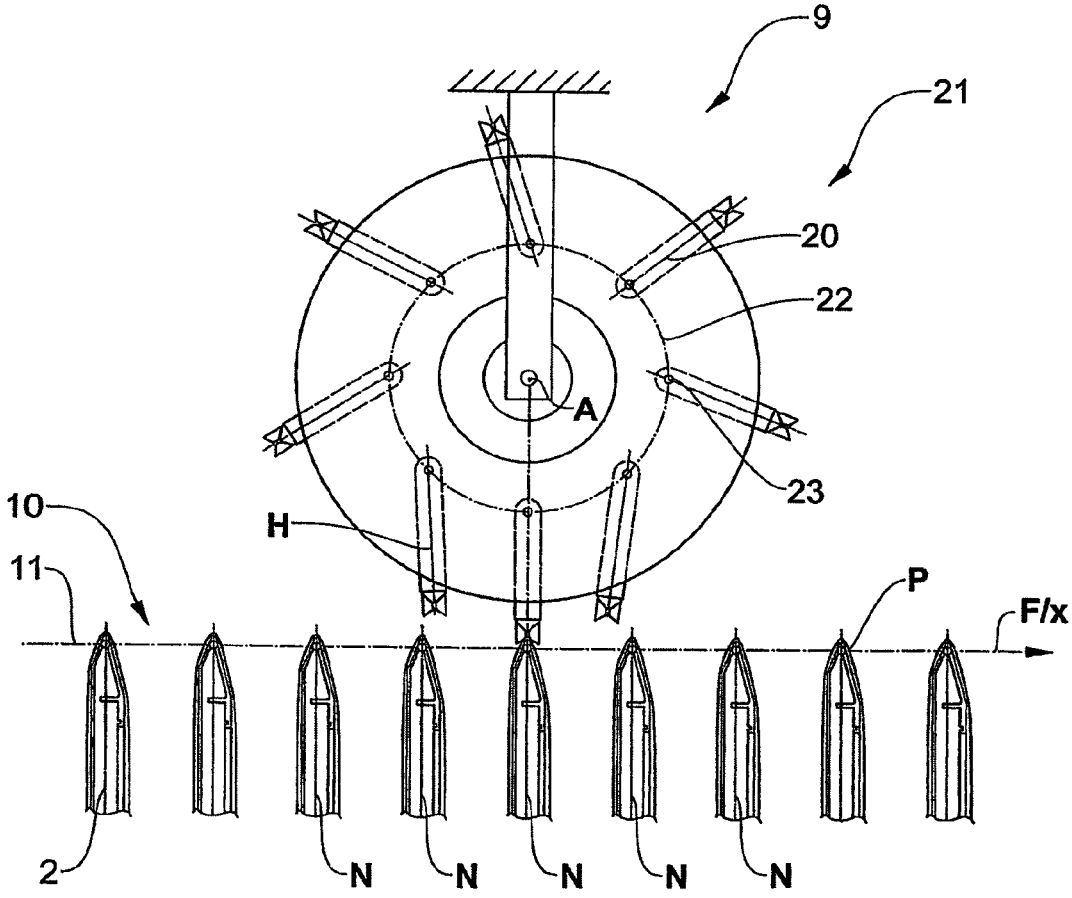
FIG. 1 a cutout of a collecting and stitching device in the region of a stitching device according to the state of the art, with which the stitching heads are pivoted, but the saddle-like rests may not be pivoted out of their transverse position.

A cut-out of the collecting and stitching device is shown in the region of a stitching head wheel 21 in a schematic view from the side in FIG. 1, with which eight stitching heads 20 rotating on the stitching head wheel 21 revolve about the axis A. The device and the method according to FIG. 1 do not correspond to the present invention, since essential features of the invention are absent. In the comparative example of FIG. 1, the stitching heads 20 and the stitching head wheel 21 are represented in a very schematic manner, and a wire section dispensing unit is left out completely. Only a cutout of a ladder circulation conveyor (Leiterumlauf), also called circulating collection conveyor 10, is shown. The circulating collection conveyor 10 comprises a multitude of saddle-like rests 2, which are led past different processing stations along a main conveying direction F by a conveyor member 11, wherein only one such processing station in the form of the stitching station is shown in FIG. 1. The drive means which move the saddle-like rest 2 arranged roughly at uniform distances transversely to the main conveyor direction by way of at least one endlessly revolving conveyor member in the clockwise direction, are likewise not represented in FIG. 1. In an upper section of the revolving system, the saddle-like rests 2 are led in an upright position orthogonally to the conveyor direction F, past a plurality of feeders, where in the known manner, part products which may comprise a folded sheet or a complete bunch are applied onto the rests, so that with regard to this, a feed according to e.g. EP 095 603 may be effected, before they reach the stitching region shown in FIG. 1. It is known to be able to arranged further stations in front of the feeders in the region of the upper section, in which the products to be fed may for example be printed or glued with cards or so-called memostick notes.

The rotation stitching apparatus 9 represented in FIG. 1 is preferably arranged in region of the upper section which is at the end with respect to the main conveyor direction F, so that the finished, stitched products P may be removed from the saddle-like rests 2 and led for example to a cutting device, before reaching the end of the section.

In FIG. 1, it is shown that the stitching heads 20 at their ends which face the central axis A of the stitching head wheel, are articulated on a circular hub 22 in a pivotably movable manner 22 by way of a bearing bolt 23. As is also evident from the figure, the stitching heads 20 may be pivoted out of their radial angular positions about the bearing bolts 23 which in the simplest case also define the stitching head axis H. The control devices necessary for the pivoting are known to the man skilled in the art, and are not represented in FIG. 1. One advantageous alignment of the stitching heads 20 to the rests which are arranged on a conveyor member in a fixed, orthogonal position N is however not effected in the device according to FIG. 3. It is clear from the subsequent description, that the stitching heads 20 and stitching head wheel 21 may be applied in the devices and methods according to the invention with a suitable selection of control devices and corresponding control sequences. The essential technical features of a stitching head wheel which may be applied in the present invention, may be deduced by the man skilled in the art from EP 691 215 for example.

A further possible construction of a stitching head wheel and of the stitching heads, as may be applied with the present invention, is known for example from EP546326 of the applicant, and is therefore not described any more in detail here. The bending of the wire sections into U-shaped staples and the driving of these into the printed products, is known for example from EP399322. These aspects of the stitching device and of the stitching procedure therefore do not have to be described in detail, and with respect to this, the detailed description of the design and the function in the mentioned documents are referred to. As initially mentioned, it has already been suggested in EP546326 to pivot the stitching heads revolving in an approximately vertical/perpendicular manner in the region of the cooperation with the rests revolving in a circular manner on a stitching drum, in a manner such that they are set somewhat obliquely with respect to the perpendicular. Such stitching devices may likewise be applied within the framework of the present invention.

In order to achieve the best results when stitching on a ladder circulation conveyor (Leiterumlauf) while applying the previously described rotation stitching heads, according to the present invention, at least one pivot axis S (cf. FIG. 2) is provided for each of the saddle-like rests on the conveyor member 11, said pivot axis being aligned essentially parallel to the rest edge 12 and permitting the saddle-like rest to be brought from an orthogonal normal position N, in which the saddle is essentially perpendicular to the main conveyor axis X defined by the conveyor member 11, into pivot positions V, R which differs from this (cf. likewise FIG. 2). As will yet be specified in more detail hereinafter, the pivot axis S may essentially coincide with the rest edge 13 of the saddle-like rest in one embodiment, and it lies above or below the rest edge 13 in other embodiments. Preferably it is not the whole pivot axis which is physically formed, but only two short lateral pivots, pivot stubs or bearing locations 14, which lie on the pivot axis S and by way of which the saddle-like rest is articulated directly or indirectly to the conveyor member 11 on both sides.

Figures 2A, 2B, 2C, 2D, 2E, 3A, 3B, 3C, 3D, 3E:
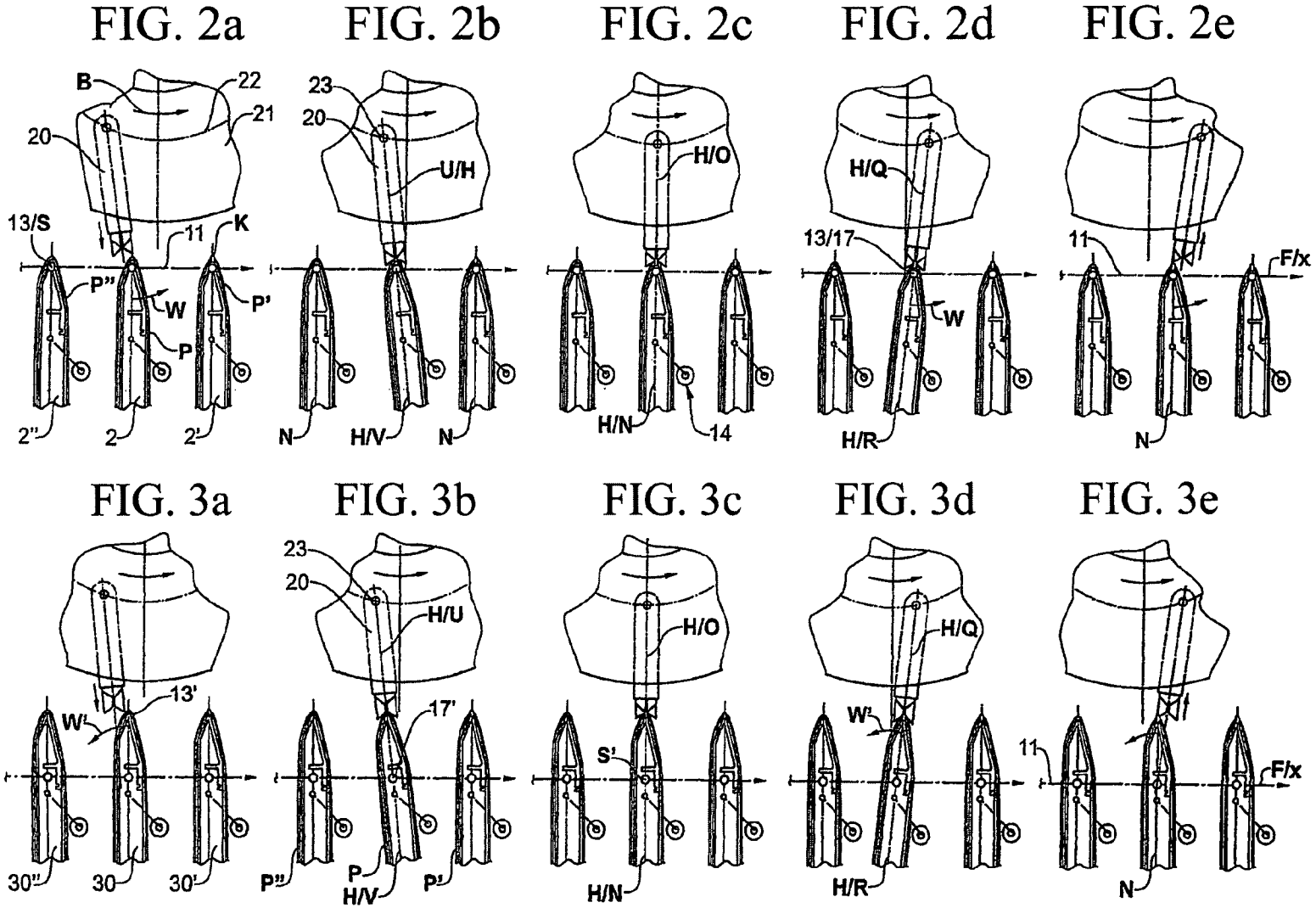
FIG. 2*a-e* in each case, a cutout of a lateral view of a collecting and stitching device in the region of a stitching device according to a first embodiment of the invention, wherein the cutouts show five consecutive points in time of a stitching procedure.
FIG. 3*a-e* in each case, a cutout of a lateral view of a gathering and stitching device in the region of a stitching device according to a second embodiment of the invention, wherein the cutouts show five consecutive points in time of a stitching procedure.

A cutout of a circulating collection conveyor 10 according to a first preferred embodiment of the present invention is shown in FIG. 2*a*. The same cut-out of the circulating collection conveyor in the region of the stitching head wheel 21 is represented in the FIGS. 2*b* to 2*e* in four further consecutive points in time during the stitching procedure. It is clear from the sequence of figures, that not only the stitching head 20, but also the saddle-like rests 2, 2', 2" are arranged in a pivotally movable manner. In each case, three rests 2, 2', 2" distanced uniformly from one another are represented in the figure. The rest 2' which leads in the conveyor direction, carries a printed product P' which is already stitched with a staple K, the middle rest carries the printed product P which is to be processed in the represented method sequence, and the trailing rest 2" carries the printed product P" to be processed in the subsequent stitching cycle. The control devices 14, 15, 16 for pivoting the rests 2, 2', and 2" are only schematically indicated in the figure, and hereinafter are explained in yet more detail by way of one embodiment example. Push members which push the rests in the conveyor direction, are applied as conveyor members in the devices according to the invention. Should it be desired, one may also apply pull members as are know for example from EP095603 of the applicant.

The pivot axes S of the rests 2, 2', 2" arranged on the conveyor member 11 essentially coincide with the respective rest edges 13, with the embodiment according to FIG. 2. In this embodiment, the bearing journals 17, by way of which the rests 2 engage on the conveyor member 11, also lie on the pivot axes S. The conveyor member 11 defines the main conveyor plane X, in which the bearing journals 17 of the rests 2 are conveyed in the main conveyor direction F with an approximately constant speed. All portions of the rests 2 with the printed product lying therein are moved with the same speed in the direction F in the orthogonal normal position of the saddle-like rests. This changes in the region of the cooperation with the stitching head 20 and is represented in an exemplary manner for the rest 2 in FIG. 4. Whilst in FIG. 2*a*, the rest 2 is still located in the normal position N which is orthogonal to the main conveyor plane X, the stitching head 20 is already pivoted into an angular position U which deviates from the orthogonal one. In a following point in time represented in FIG. 4*b*, the receiver 2 is pivoted in the direction W into a position V, and thereby is aligned to the stitching head 20, in a manner such that the portions which participate directly in the stitching procedure both come to lie in a stitching plane H. In the time interval which is represented in FIGS. 2*b* to 2*d*, although the position of the stitching head 20 and the rest 2 continuously change with respect to the main conveyor plane X, their position to one another in the stitching plane H remains unchanged, so that the stamp, ram and the bending device cooperating therewith, are held in an optimal alignment to one another for as long as possible. In FIG. 2*c*, the stitching head and the rest are located for a moment in the orthogonal position H/O, from which however they are moved into the respective pivot positions Q, and R without thereby leaving the stitching plane, by way of the pivot movement superimposed on the conveyor movement in the direction F. This is effected only after termination of the stitching procedure, when, as is represented in FIG. 2*e*, the contact between the stitching head 20 and the rest edge 13 of the rest 2 is released and the rest 2 is pivoted back into the orthogonal normal position. Since the rests 2 was continuously pivoted counter to the initial pivot direction W, from the initial position V into the end position R during the stitching procedure, it must be pivoted again in the direction W for the return into the normal position N. The pivot axis with this arrangement coincides essentially with the rest edge, so that the rest and the respective stitching head tip as well as the conveyor means have essentially the same speed in the stitching region. The movement control of the stitching head is effected by way of means which are not represented in more detail here, in the manner according to EP546326 and in a manner such that this runs through the inventive pivoting about the pivot axis S of the rests.

In a further embodiment of the invention, as is shown in FIG. 3, the pivot axes S' of the rests 30 do not coincide with the rest edges 13'. The pivot axes S' again lie in the main conveyor plane X, but the rest edges 13' are arranged above the pivot axes S'. In order to move the rests 30, 30', 30" into the position V coinciding with the stitching plane H, the rest edge 13' must therefore be pivoted against the main conveyor direction F about the pivot axis S' in the direction W', as is indicated in the FIGS. 3*a* and *b*. The pivot axis again lies in the main conveyor plane X, so that all portions of the rests 30, which lie above the main conveyor planes X, are pivoted in the direction W' and all portions of the rest 30 which lie below the main conveyor planes X, in the opposite direction. As described for the embodiment example of FIG. 2, the stitching head 20 and the rest 30 remain in the stitching plane H during the complete stitching procedure, so that the rest must be pivoted again in the direction W' into the normal position N after the end of the stitching procedure.

Figures 4A, 4B, 4C, 4D, 4E:
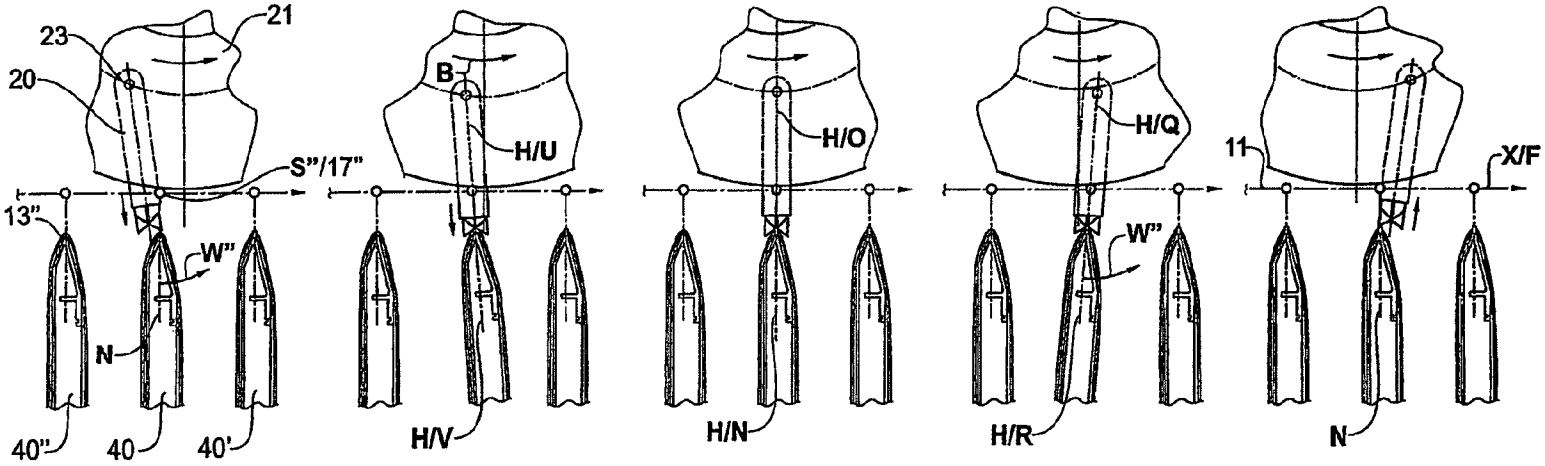
FIG. 4*a-e* in each case, a cut-out of a lateral view of a gathering and stitching device in the region of a stitching device according to a third embodiment of the invention, wherein the cut-outs show five consecutive points in time of the stitching procedure.

A further preferred embodiment is represented in FIG. 4, with which the rest edges 13" of the rests 40, 40', 40" are arranged below the main conveyor plane X. The pivot axes S" again lie in the main conveyor plane X, but since the rest edges 13" are arranged below the pivot axes S", the rests 40, 40', 40" must be pivoted in the direction W", in order to move them into the position V coinciding with the stitching plane H, and the rest edge 13" must therefore be pivoted counter to the main conveyor direction F about the pivot axis S" in the direction W". Together with the rest edge 13", as is indicated in the FIGS. 4*a* and *b*, all portions of the rest 40 are pivoted about the pivot axis S" in the direction W", since all portions of the rest 40 lie below the main conveyor plane X. The stitching head 20 and the rest 40 again lie in the stitching plane H during the conveying and during the whole stitching procedure, so that the rest 40 again must be pivoted in the direction W" into the normal position N at the end of the stitching procedure.

Figure 5:
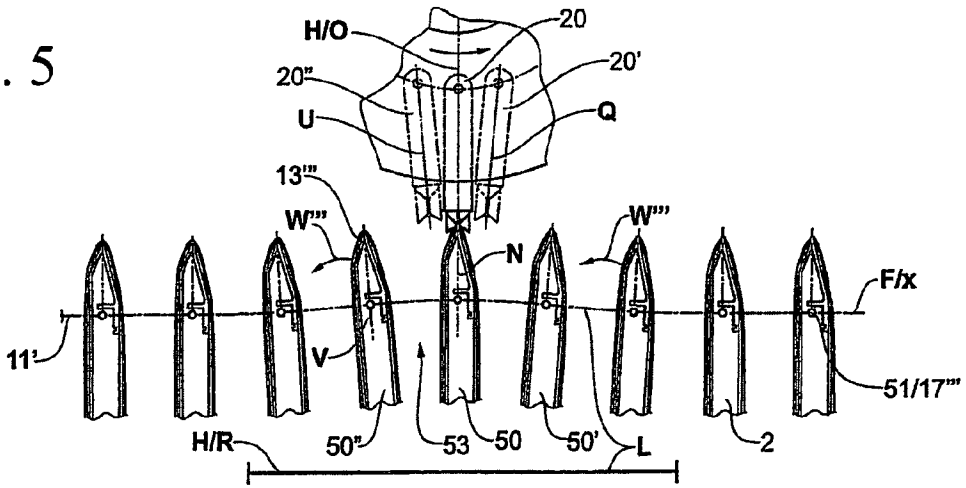
FIG. 5 a cut-out of a lateral view of a collecting and stitching device in the region of a stitching device according to a fourth embodiment of the invention, wherein three consecutive points in the time of the stitching procedure are shown in the cutout.

In the three embodiments of FIGS. 2 to 4, the stitching head 20 and the saddle-like rests 2, 30, 40 during the stitching are pivoted in the stitching plane H in each case by a pivot axis S, S', S" which is defined by the bearing means 17, 17', 17" of the rests 2, 30, 40 on the conveyor members 11. Moreover, one may recognize that the pivot axes S of the rests are moved in a horizontal plane. A further preferred embodiment according to the present invention is shown in FIG. 5, which, with regard to this, differs from the previously mentioned arrangements. The rests 50 at least in the region of the cooperation with the stitching heads 20 are pivoted out of the main conveyor plane X by way of a guide path 53, so that the rest edges 13'" briefly describe a sector L in the direction towards the stitching head, before they are transported back in the main conveyor plane X in the main conveyor direction F. Since the rests 50 again come to lie in the stitching plane H despite the superimposed radial movement along L in the direction of the cooperation with the stitching heads 20, the pivot axis lies distanced to the bearing means 51 on conveyor means II' and guide path 53. The movement or the control of the rests 50 out of the main conveyor plane X is preferably effected by a carriage guide system with at least two rest points, a pendulum system with an additional control link or a pendulum system with a temporary fixation of the rest.

The rest 50 and the stitching head 20 in FIG. 5 are located in the stitching plane, which at the represented point in time coincides with the normal position N which is orthogonal to the main conveyor plane X. However, they are moved out of this by the pivot movement superimposed on the conveyor movement, into the respective pivot positions Q and R, without thereby leaving the stitching plane. This is not effected until after the completion of the stitching procedure, when as indicated by the rest 50' and the stitching head 20', the contact between the stitching head 20 and the rest edge 13" of the rest 50' is released and the rest is pivoted back into the orthogonal normal position N (similarly as in FIG. 3*a*). Since the rest is continuously pivoted counter to the initial pivot direction W" out of the initial position V into the end position R during the stitching procedure, it must be pivoted again in the direction W" for the return into the normal position N. The stitching head positions 20" and 20' which are not represented true to scale, represent the stitching head pivoted in the angular positions U and Q respectively, which deviate from the orthogonal one O. The receivers 50" and 50' are accordingly represented pivoted into their positions V and R.

Although again the angular position of the stitching head 20 and the rest 50 with respect to the main conveyor plane X continuously changes during the stitching, their position to one another in the stitching plane H however remains unchanged, so that the stamp, ram of the stitching head and the bending unit of the rest cooperating therewith are held to one another in the desired manner in an optimal alignment. The movement path of the pivot axes of the rests of the preferred embodiment according to FIG. 5 is raised in the stitching region above the main conveyor plane X. According to the solution according to FIG. 3*a*, here the rests (together with the respective stitching head tip) have a greater speed than the conveyor means, so that an optimal cooperation with the shown rotation stitching device may be effected.

In each case, only one stitching head is shown in the FIGS. 2 to 5. However, it is evident to the man skilled in the art that each of the represented stitching heads 20 in the figures symbolizes a series of two, three or more stitching head which are applied for the simultaneous stitching in each case of one printed product, in the devices according to the invention.

With the shown embodiments, the rests are moved essentially linearly along the horizontal main conveyor plain. With particular embodiments, it may be desirable for the rest to be moved in a path which lies in the main conveyor plane X and which differs from a linear movement path. The inventive concept also includes solutions, with which the rests may not be feed with printed sheets in a manner pivotably mounted on both sides, but only on one side. In this case, an additional support of the free end of the rest which permits an additional force accommodation is provided in the stitching region.

Figure 6:
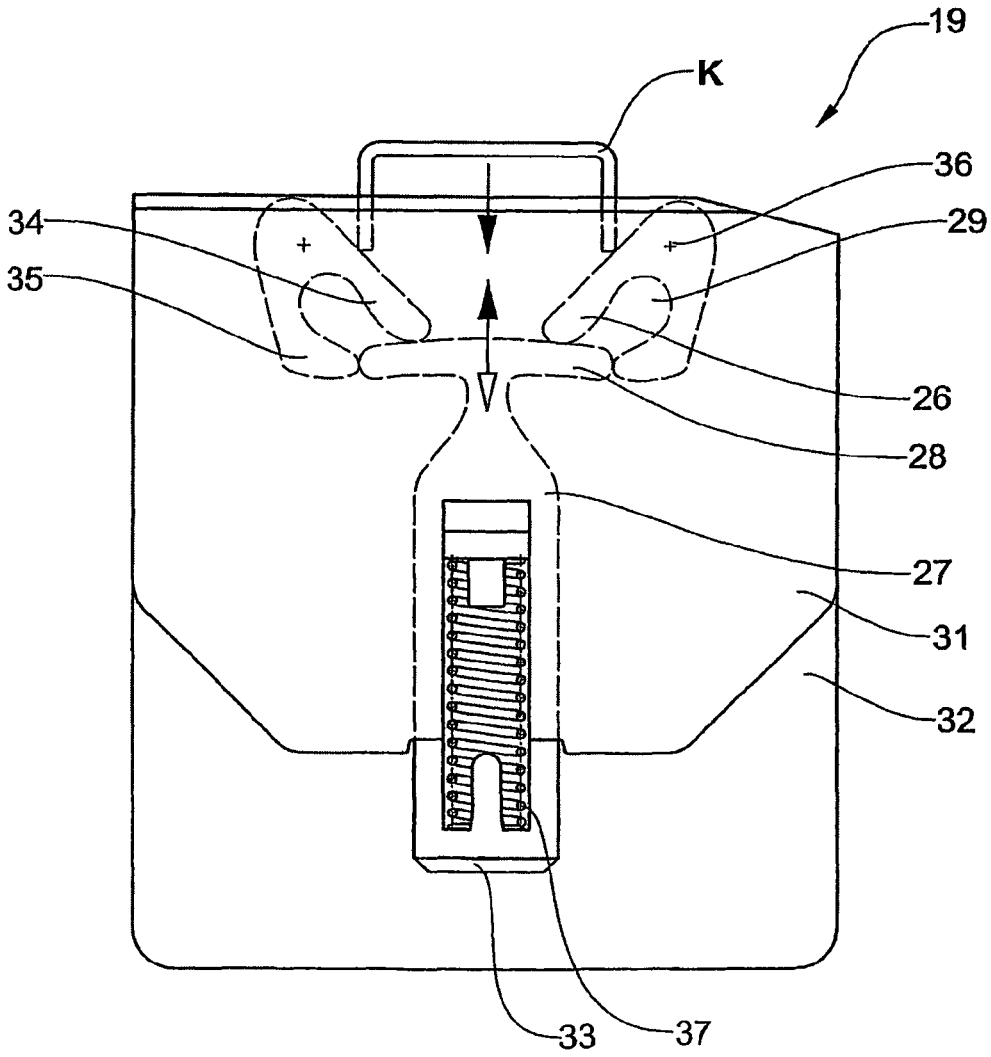
FIG. 6 a bending unit, as is preferably applied in the rests according to the invention.

Stitching heads with rams which stamp the staples through the paper of the products to be stitched, are known from the state of the art, as mentioned above. One preferred embodiment of a bending unit 19 which closes and presses the staple ends projecting freely downward out of the paper after the piercing by way of bending wings 26, is represented in FIG. 6. On stitching, a stamp 27 which is impinged by spring force is pressed upwards against the staple K. The stamp and the two bending wings 26 are held between a first 31 and a second 32 bearing plate. The stamp may be pushed upwards against the force of a restoring spring 37 by way of pressure on a vertically projecting lug 33 at the lower end of the stamp 27. The first bearing plate 32 is shortened with respect to the second bearing plate 32, so that the lug 33 is accessible from one side. In the upper region of the bending unit, the plates 31, 32 are approximately equal high, so that they define a receiving gap for the staple 7 to be bent. An anvil 28 arranged on the upper side on the stamp, engages on both sides into receiver grooves 29 of the bending wings 26. The bending wings 23 are pivoted about axes 36 and with their upper bending limbs 34 press against the staple ends. The anvil cooperates with a restorer 35 of the bending wing 26 with the upwards movement of the stamp 27 which is driven by spring force, and pivots this wing back into a lower opposition as is represented in FIG. 6.

Figure 7:
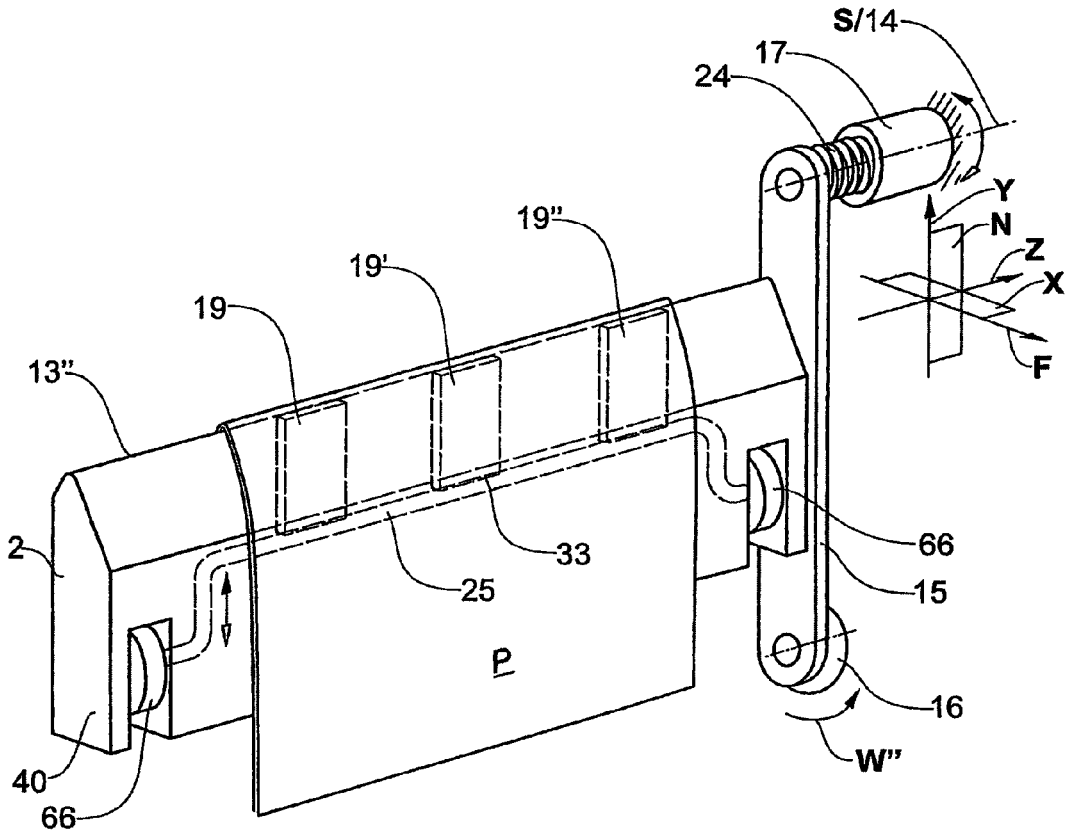
FIG. 7 one embodiment of a saddle-like rest as is shown for example in a collecting and stitching device according to FIG. 4, with which the left parts of the suspension are not represented.

A saddle-like rest 40, as is preferably applied in an embodiment of the invention according to FIG. 4, is shown in FIG. 7. The printed product P to be stitched lies with the bunch web on the rest edge 13" for stitching. In the shown embodiment, the rest 40 comprises three bending units 19, 19', 19". The upper edges of the bending units 19, 19', 19" are flush with the rest edge 13" or project slightly beyond these, so that they represent an actual functional rest edge. The bending units 19, 19', 19" are actuated via a continuous control bar 25 which is provided with control rollers 66 on both sides. The control bar 25 engages from below onto the stamp 27 of the bending units 19, 19', 19" which for this are equipped preferably with the lugs 33, as shown in FIG. 7. The control rollers 66 and thus the control bar 25 may be pushed upwards in the stitching region by way of a control link which again is not shown in the figure. This upwards movement of the control bar 25 is transmitted to stamp, anvil and the bending wings, which are moved upwards against the force of the restoring spring 37. This upwards movement is coordinated precisely with the penetration of the staples by the stitching head, in order to achieve a qualitatively perfect stitching result.

The pivoting movement ability of the rest 40 about the pivot axis S is provided by a suspension 14 which is only represented at the side of the installation which is on the left with regard to the conveyor direction F. The rest 40 is fastened on two lateral pendulums 15 of the suspension 4, so that the rest edge 13" comes to lie significantly distanced below the pivot axis S. The bearing journals 17 engage on the conveyor member which is not represented, and define the pivot axis S. The rests 40 are held relative to the conveyor direction F in the orthogonal normal position N by a restoring spring 24, as long as no force is exerted onto the free end of the pendulum 15, which is opposite the pivot axis. A pendulum roller 16 is preferably arranged there, which on stitching cooperates with a control cam and controls the pivot movement of the saddle-like rest. The pendulum roller 16 may also serve for additionally supporting the rest during the stitching procedure.

It is evident that the rest 40 according to FIG. 7 may be retrofitted accordingly into the receivers of FIGS. 2 and 3 by way of changing the vertical assembly position on the pendulum 15. After releasing the fastening between the rest 40 and the pendulum 15, the rest edge 13" may be displaced upwards towards the pivot axis S and parallel to the axis beyond this.

The rest according to FIG. 7, on account of its new type of suspensions, permits the inventive cooperation with the stitching head in the stitching region. An essential feature of the present invention is that the stitching head and the rest are pivoted to one another such that they come to lie within a common stitching plane. This means that the saddle plane defined by the pivot axis or pivot axes of the saddle-like rest and the rest edge, and the stitching head plane defined by the pivot axis of the stitching head and the ram tip, are superimposed on one another in the region of, and during, the time of the cooperation, and this defines the so-called stitching plane. The stitching plane thereby is continuously pivoted, so that it is orthogonal to the main conveyor plane X at the desired location. In preferred embodiments, the rests may be aligned in a passive manner during the pivoting movement. The rests may be controlled in a purely passive manner by way of the active connection with the stitching device and the suitable choice and arrangement of the control means, which significantly simplifies the design and considerably cheapens the device.

With the embodiment according to FIG. 2, the pivot axis S and the rest edge 13 coincide in the main conveyor plane X, so that no movement of the rest edge 13 out of the plane X occurs with the inventive pivoting. In contrast to this, the rest edge is moved relative to the main conveyor plane by way of the pivoting of the rests, with the embodiments according to FIGS. 3 and 4, which means that their vertical distance to the main conveyor plane changes. This height difference is of no importance with the supply of products onto the pivotably movable saddle-like rests, as is known from DE 19638448, since no direct active contact between product supply stations and the saddle-like rest occurs. However, on stitching, a direct active contact between the stitching device and the rest is fundamental, and this height difference may be of importance and influence the quality or the operation result. As already mentioned above, when stitching, indeed one does not pivot in the device according to DE 19638448. In further embodiments of the invention, one corrects with regard to the height change of the rest edges which is caused by the pivoting. This is effected preferably by guide means, for example guide paths or control cams, as have been described already in principle for the control of the pivot movement with the embodiment according to FIG. 5. One controls in an active or passive manner, in order to hold the rest edges essentially in a plane which lies parallel to the main conveyor plane X, during the cooperation with the stitching heads.

It is clear from the above explanations, that the device 10 according to the invention for gathering, transporting, and stitching multi-part folded' printed predicts comprises at least one endlessly revolving conveyor member 11 which comprises a plurality of saddle-like rests 2, 30 40, 50 for the straddled receipt of the printed products along a conveyor path F with rest edges 13 directed transversely to the conveyor path. The conveyor member 11 conveys the saddle-like rests 2, 30, 40, 50 past at least one working station, wherein at least one working station comprises a stitching station 9 with at least one stitching head 20 mounted in a pivotably movable manner. A main conveyor axis X is defined by the conveyor member 11, and the saddle-like rests 2, 30, 40, 50 are arranged on the conveyor member 11 in a pivotably movable manner. Each rest 2, 30, 40, 50 in a region of the cooperation, on stitching and with in each case at least one stitching head 20, is subjected to a coordinated pivot movement about a common pivot axis, so that the stitching head 20 and the saddle-like rest 2, 30, 40, 50 dwell in a stitching plane H whilst retaining an advantageous 180° angular position, whilst they are pivoted with respect to a main conveyor plane X. It is evident to the man skilled in the art, that this 180° angular position does not have to be exact or retained permanently, for design reasons and/or kinematics reasons, but that slight deviations from this 180° angular position, which are dependent on the movement and stitching, may occur.

In a preferred embodiment, the stitching device 9 is a stitching device with a plurality of stitching heads 20 which are mounted in a pivotably movable manner along a circular revolving path.

In the general as well as preferred embodiment, the saddle-like rests 2, 30, 40, 50 and the endlessly revolving conveyor member 11 form a circulating collection conveyor.

In a preferred embodiment, the saddle-like rests 2, 2', 2" are articulated on the conveyor member 11 in a pivotably movable manner in the main conveyor plane X defined by the conveyor member 11, wherein the pivot axis S is aligned coaxially to a rest edge 12, so that the saddle-like rest 2, 2', 2" may be brought from an orthogonal normal position N, in which it is essential perpendicular to the main conveyor axis X defined by the conveyor member 11, into pivot positions V, R differing therefrom, wherein on pivoting between pivot positions V, R, it lies in each case together with the stitching head 20 in the stitching plane H.

In a further preferred embodiment, the device is characterized in that the saddle-like rests 30, 30', 30" are articulated on the conveyor member 11 in a pivotably movable manner in the main conveyor plane X defined by the conveyor member X, wherein the pivot axis S' runs parallel below a rest edge 13', so that the saddle-like rest 30, 30', 30" may be brought from an orthogonal normal position N, in which it is essentially perpendicular to the main conveyor axis X defined by the conveyor member 11, into pivot positions V, R differing therefrom, wherein on pivoting between pivot positions V, R, it lies in each case together with the stitching head 20 in the stitching plane H. With this device, the rest edge 13' on pivoting the rests 30, 30', 30" into the stitching plane, is designed pivotable counter to the main conveyor direction F about the pivot axis S' in the direction W'.

In a further embodiment, the saddle-like rests 40, 40', 40" are articulated on the conveyor member 11 in a pivotably movable manner in the main conveyor plane X defined by the conveyor member 11, wherein in contrast to the two previously described embodiments, the pivot axis S" runs parallel above a rest edge 13', such that the saddle-like rest 40,40', 40" may be brought from an orthogonal normal position N, in which it is essentially perpendicular to the main conveyor plane X defined by the conveyor member 11, into pivot positions V, R differing therefrom, wherein on pivoting between pivot positions V, R, it lies in each case together with the stitching head 20 in the stitching plane. With these devices, preferably all portions of the rest 40, together with the rest edge 13", are arranged below the main conveyor plane X.

In a fourth preferred embodiment of the device according to the invention, the saddle-like rests 50, 50', 50" at least in the region of the cooperation with the stitching heads 20, may be moved through a guide path 53 out of the main conveyor plane X, so that the rest edges 13'" briefly describe a sector L in the direction of the stitching head 20, wherein the pivot axis S" runs parallel below the rest edge 13'", so that the saddle-like rests 50, 50', 50" may be brought from an orthogonal normal position N in which they are essentially perpendicular to the main conveyor plane X defined by the conveyor member 11, into pivot positions deviating therefrom, wherein on pivoting between pivot positions V, R, they lie together with the stitching head 20 in the stitching plane H. The pivot axis of the saddle-like rests 50, 50', 50" is preferably distanced from the bearing means 51 and thus distanced from the conveyor means 11' and the guide path 53.

The movable mounting of the saddle-like rest 2,30,40,50 may be designed in a manner such that the rest edges 13, 13', 13", 13'" of the saddle-like rests 2, 30, 40, 50 and the stitching edges of the stitching heads 20 may be led in the whole stitching region with a smaller, larger or equal relative speed in comparison to the speed of the conveyer member, wherein the optimal alignment of the stitching heads 20 and the rests 2,30,40, 50 in the stitching plane H is always ensured.

More preferably, the upper edges of the bending units 19, 19', 19" are flush with the rest edge 13, 13', 13", 13'" or projects slightly beyond these. Thereby, the bending units 19, 19', 19" may be actuated via a control bar 25 which is mounted up and down in a movable manner continuously in the rest and which is provided with control rollers 66 on both sides With the device according to the invention, a spring-loaded stamp 27 of the bending units 19, 19', 19" may comprise an anvil 28 arranged on the upper side, which on both sides engages into receiver grooves 29 of bending wings 26, so that the bending wings 26 positively convert upwards and downwards movements of the anvil into pivot movements about axes 36.

The method according to the invention for collecting, transporting and stitching multi-part folded printed products with a device 10 with at least one endlessly revolving conveyor member 11, which comprises a plurality of saddle-like receivers 2, 30, 40, 50 for the straddled receipt of the printed products along a conveyor path F with rest edges 13 directed transversely to the conveyor path, and the conveyor member 11 transports the saddle-like rests 2, 30, 40, 50 past at least one working station, wherein at least one working station comprises a stitching station 9 with at least one stitching head 20 mounted in a pivotably movable manner, wherein a main conveyor plane X is defined by the conveyor member 11, is characterised in that the stitching head 20 and the saddle-like rest 2, 30, 40, 50 in a region of the cooperation, on stitching, run through a coordinated pivot movement about a common pivot axis, so that the stitching head 20 and the saddle-like rest 2, 30, 40, 50 dwell in a stitching plane H whilst retaining an advantageous 180° angular position to one another, whilst they are pivoted with respect to the main conveyor plane X.

The stitching device 9 preferably comprises a stitching device with stitching heads 20 which are mounted in a pivotably movable manner along a circular revolving path, so that portions of the stitching heads, in particular a stitching edge, do not revolve in a circular path during the revolution about a rotation axis A of the stitching device.

In a preferred embodiment of the method according to the invention, the saddle-like rests 2, 2', 2" are articulated on the conveyor member 11 in a pivotably movable manner in the main conveyor plane X defined by the conveyor member 11, wherein the pivot axis 8' is arranged coaxially to a rest edge 13', so that the saddle-like rests 2, 2', 2" may be brought from an orthogonal normal position N, in which they are essentially perpendicular to the main conveyor plane X defined by the conveyor member 11, at the start of the stitching procedure, into a pivot position which differs therefrom and in which together with the stitching head 20 they lie in the stitching plane H and subsequently, whilst retaining the 180° angular position to the stitching head 20, are pivoted whilst in the stitching plane H, until a pivot position R. With the method, the rest edges 13 of the saddle-like rests 2, 2', 2" and the stitching edges of the stitching heads 20 in the whole stitching region, are led preferably with the same relative speed in comparison with the speed of the conveyor member 11, wherein the optimal alignment of the stitching heads 20 and the rests 2, 2', 2" in the stitching pane H is always ensured.

In a further preferred embodiment of the method according to the invention, the saddle-like rests 30, 30', 30" in the main conveyor plane X defined by the conveyor member 11, are articulated on the conveyor member 11 in a pivotably movable manner, but the pivot axis 8' runs parallel below a rest edge 13', so that the saddle-like rest 30, 30', 30" at the beginning of the stitching procedure may be brought from an orthogonal normal position N, in which they are essential perpendicular to the main conveyor plane X defined by the conveyor member 11, into a pivot position V which differs therefrom and in which together with the stitching head 20, they lie in the stitching plane H, and subsequently whilst retaining the 180° angular position to the stitching head 20, are pivoted whilst in the stitching plane H, until a pivot position R. With this method, the rest edges 13' of the saddle-like rests 30, 30', 30", and the stitching edges of the stitching heads 20 in the whole stitching region are preferably led with a higher relative speed in comparison to the speed of the conveyor member 11, wherein the optimal alignment of the stitching heads 20 and the rests 30,30', 30" in the stitching plane H is always ensured.

In a third embodiment of the method according to the invention, the saddle-like rests 40, 40', 40" are articulated on the conveyor member 11 in a pivotably movable manner in the main conveyor plane X defined by the conveyor member 11, but the pivot axis S' runs parallel above a rest edge 13', so that the saddle-like rests 40, 40', 40' at the beginning of the stitching procedure may be brought from an orthogonal normal position N, in which they are essentially perpendicular to the main conveyor plane X defined by the conveyor member 11, into a pivot position V which differs from this and in which together with the stitching heads 20, they lie in the stitching plane H, and subsequently whilst retaining the 180° angular position to the stitching head 20, may be pivoted whilst in the stitching plane H, until a pivot position R. With this method, the rest edges 13 of the saddle-like rests 40, 40', 40" and the stitching edges of the stitching heads 20 are led preferably in the whole stitching region with a relative speed which is lower compared to the speed of the conveyor member 11, wherein the optimal alignment of the stitching heads 20 and of the rest 40,40', 40" in the stitching pane H is always ensured.

In a fourth preferred embodiment of the method according to the invention, the saddle-like rests 50, 50', 50" at least in the region of the cooperation with the stitching heads 20, are moved through a guide path 53 out of the main conveyor plane X in the direction of the stitching head 20, so that the rest edges 13'" briefly describe a sector L in the direction of the stitching head 20, wherein the pivot axis S" runs parallel below a rest edge 13'", so that the saddle-like rests 50, 50, 50" at the beginning of the stitching procedure are brought from an orthogonal normal position N, in which they are essentially perpendicular to the main conveyor plane X defined by the conveyor member 11, into a pivot position differing therefrom, in which together with the stitching head 20, they lie in the stitching plane, and subsequently whilst retaining the 180° angular position to the stitching head 20, are pivoted whilst in the stitching plane H, until a pivot position R. With this method, the rest edges 3'" of the saddle-like rest 50, 50', 50" and the stitch edges of the stitching heads 20 are preferably led in the whole stitching region with a relative speed which is greater compared to the speed of the conveyor member 11, wherein the optimal alignment of the stitching heads 20 and of the rests 50, 50', 50" in the stitching plane H is always ensured.

The rest edges 13, 13', 13", 13'" of the saddle-like rests 2, 30, 40, 50 and the stitching edges of the stitching heads 20 in the whole stitching region may be led with a smaller, larger or the same relative speed in comparison to the speed of the conveyor member 11, wherein the optimal alignment of the stitching heads 20 and of the rest 2, 30, 40, 50 in the stitching plane His always ensured.

The invention claimed is:

1. A device (10) for collecting, transporting and stitching multi-part, folded printed products with at least one endlessly revolving conveyor member (11) comprising:

a plurality of saddle-like rests (2, 30, 40, 50) for the straddled receipt of the printed products along a conveyor path, with rest edges (13) aligned transversely to the conveyor path, and the conveyor member (11) conveys the saddle-like rests (2, 30, 40, 50) past at least one working station, wherein at least one working station comprises:

a stitching station (9) with at least one stitching head (20) mounted in a pivotably movable manner, wherein a main conveyor plane (X) is defined by the conveyor member (11), wherein the saddle-like rests (2, 30, 40, 50) are arranged on the conveyor member (11) in a pivotably movable manner, and each saddle-like rest (2, 30, 40, 50) in a region of stitching, cooperates with at least one stitching head (20) through a coordinated pivot movement about a common pivot axis, so that the stitching head (20) and the saddle-like rest (2, 30, 40, 50), while retaining an angular position of approximately 180° , dwell in a stitching plane (H), while the stitching head (20) and the saddle-like rest (2, 30, 40, 50) are pivoted with respect to the main conveyor plane (X);

wherein each saddle-like rest is articulated on the conveyor member (11) in a pivotably movable manner in the main conveyor plane (X), so that the saddle-like rest is brought from an orthogonal normal position (N), in which it is generally perpendicular to the main conveyor plane X defined by the conveyor member (11), into pivot positions (V, R) different from the normal position, wherein on pivoting between pivot positions (V, R), the saddle-like rest lies aligned with the stitching head (20) in the stitching plane (H).

2. A device according to claim 1, wherein the stitching station (9) comprises a rotation stitching device with a plurality of stitching heads (20) mounted in a pivotably movable manner along a circular revolving path.

3. A device according to claim 1 wherein the pivot axis (S) is aligned coaxially to a rest edge (13) of each of the saddle-like rests (2, 2', 2").

4. A device according to claim 1 wherein the saddle-like rests (30, 30', 30') are articulated on the conveyor member (11) in a pivotably movable manner in the main conveyor plane (X) defined by the conveyor member (11), wherein the pivot axis (S') runs parallel below a rest edge (13'), so that each saddle-like rest (30, 30', 30") may be brought from an orthogonal normal position (N), in which the saddle-like rest (30, 30', 30") is essentially perpendicular to the main conveyor plane (X) defined by the conveyor member (11), into pivot positions (Y, R) different from the normal position (N), wherein on pivoting between the pivot positions (Y, R), the saddle-like rest (30, 30', 30") is aligned with the stitching head (20) in the stitching plane (H).

5. A device according to claim 1 wherein the rest edge (13'), on pivoting the rests (30, 30', 30") into the stitching plane (H), pivots counter to a main conveyor direction (F) about the pivot axis (S') in the direction (W').

6. A device according to claim 1 wherein the saddle-like rest (50, 50', 50") at least in the region of the cooperation with the stitching heads (20), may be moved out of the main conveyor plane (X) by way of a control (53), so that the rest edges (13'") briefly describe a sector (L) in the direction towards the stitching head (20), wherein the pivot axis (S") runs parallel below a rest edge (13'"), so that the saddle-like rests (50, 50', 50) may be brought from an orthogonal normal position (N), in which the saddle-like rests (50, 50', 50) are essentially perpendicular to the main conveyor plane (X) defined by the conveyor member (11), into pivot positions (V, R) different from the normal position (N), wherein on pivoting between pivot positions (V, R), the saddle-like rests (50, 50', 50) lie in each case together with the stitching head (20) in the stitching plane (H).

7. A device according to claim 1 wherein the pivot axis of the saddle-like rests (50, 50', 50") is positioned at a distance with respect to a bearing and the conveyor.

8. A device according to claim 1 wherein a movable mounting of the saddle-like rests (2, 30, 40, 50) is arranged such that the rest edges (13, 13', 13", 13'") of the saddle-like rests (2, 30, 40, 50), and the stitching edges of the stitching heads (20), in the complete stitching region, is led with a smaller, larger or equal relative speed in comparison to a speed of the conveyor member (11), wherein an optimal alignment of the stitching heads (20) and of the rests (2, 30, 40, 50) in the stitching plane (H) is always ensured.

9. A device according to claim 1 wherein the upper edges of bending units (19, 19', 19") are one of generally flush with the rest edge (13, 13', 13", 13'") or project slightly beyond the rest edge (13, 13', 13", 13'").

10. A device according to claim 9 further comprising:

a spring-loaded stamp (27) of the bending units (19, 19', 19"), the spring-loaded stamp (27) including an anvil (28) arranged on an upper side and engaging into receiver grooves (29) of bending wings (26) on both sides, so that the bending wings (26) positively convert upwards or downwards movements of the anvil into pivot movements about axes (36).

11. A device (10) for collecting, transporting and stitching multi-part, folded printed products with at least one endlessly conveyor member (11) comprising:

a plurality of saddle-like rests (2, 30, 40, 50) for the straddled receipt of the printed products along a conveyor path, with rest edges (13) aligned transversely to the conveyor path, and the conveyor member (11) conveys the saddle-like rests (2, 30 40 50 past at least one working station, wherein at least one working station comprises:

a stitching station (9) with at least one stitching head (20) mounted in a pivotably movable manner, wherein a main conveyor plane (X) is defined by the conveyor member (11), wherein the saddle-like rests (2, 30, 40, 50) are arranged on the conveyor member (11) in a pivotably movable manner, and each of the saddle-like rests (2, 30, 40, 50) in a region of stitching, cooperates with at least one stitching head (20) through a coordinated pivot movement about a common pivot axis, so that the stitching head (20) and the saddle-like rest (2, 30, 40, 50), while retaining an angular position of approximately 180°, dwell in a stitching plane (H), while the stitching head (20) and the saddle-like rest (2, 30, 40, 50) are pivoted with respect to the main conveyor plane (X);

wherein the saddle-like rests (40, 40', 40") are articulated on the conveyor member (11) in a pivotably movable manner in the main conveyor plane (X) defined by the conveyor element (11), wherein the pivot axis (S") runs parallel above a rest edge (13"), such that each saddle-like rest (40, 40', 40") may be brought from an orthogonal normal position (N), in which the saddle-like rest (40, 40', 40") is generally perpendicular to the main conveyor plane (X) defined by the conveyor member (11), into pivot positions (V, R) different from the normal position (N), wherein on pivoting between pivot positions (V, R), the saddle-like rest (40,40', 40") lies in each case together with the stitching head (20) in the stitching plane (H).

12. A device according to claim 11, wherein the rest edge (13") and all portions of the rest (40) are arranged below the main conveyor plane (X).

13. A device (10) for collecting, transporting and stitching multi-part, folded printed products with at least one endlessly revolving conveyor member (11) comprising:

a main conveyor plane (X) defined by the conveyor member (11);

a plurality of saddle-like rests (2, 30, 40, 50) for the straddled receipt of the printed products, and mounted in a pivotably movable manner on the conveyor member (11) and with rest edges (13) aligned transversely to the conveyor path; and a working station comprising a stitching station (9) with stitching heads (20) each mounted in a pivotably movable manner to a rotating hub (22), wherein a main conveyor plane (X) is defined by the conveyor member (11);

wherein the saddle-like rests (2, 30, 40, 50) convey on the conveyor member (11) past the working station, each of the stitching heads (20) aligns in a region of stitching with one of the saddle-like rests (2, 30, 40, 50) through a coordinated pivot movement with respect to the main conveyor plane (X) to provide a 180° angular position to one another.

* * * * *